US006173847B1

(12) United States Patent
Zellner, III et al.

(10) Patent No.: US 6,173,847 B1
(45) Date of Patent: Jan. 16, 2001

(54) STORAGE RACK

(75) Inventors: James Zellner, III, Center Valley, PA (US); Martin Snider, New City, NY (US)

(73) Assignee: E-Z-Do, Inc., Edison, NJ (US)

( * ) Notice: Under 35 U.S.C. 154(b), the term of this patent shall be extended for 0 days.

(21) Appl. No.: 09/360,428

(22) Filed: Jul. 26, 1999

(51) Int. Cl.[7] ..... A47B 4/00
(52) U.S. Cl. ..... 211/186
(58) Field of Search ..... 211/186, 187, 211/133.1, 133.2

(56) References Cited

U.S. PATENT DOCUMENTS

| | | | | |
|---|---|---|---|---|
| 2,315,595 | * | 4/1943 | Chappory | 211/186 |
| 3,007,708 | * | 11/1961 | Ochs | 211/187 |
| 3,280,989 | * | 10/1966 | Melvin et al. | 211/187 |
| 3,435,958 | * | 4/1969 | Chesley | 211/186 |
| 3,487,951 | * | 1/1970 | Beltzung | 211/133.2 |
| 4,231,301 | * | 11/1980 | Barrineau, III | 211/187 |
| 4,292,902 | * | 10/1981 | Barrineau | 211/187 |
| 4,391,378 | * | 7/1983 | Secon | 211/187 |
| 5,251,973 | * | 10/1993 | Hazan | 211/186 |
| 5,718,441 | * | 2/1998 | Kern et al. | 211/187 |

* cited by examiner

*Primary Examiner*—Alvin Chin-Shue
*Assistant Examiner*—Sarah Purol
(74) *Attorney, Agent, or Firm*—Fattibene & Fattibene; Arthur T. Fattibene; Paul A. Fattibene

(57) ABSTRACT

A storage rack having a plurality of shelves between end frames. Each of the plurality of shelves has U-shaped retainers that are snap fit, press fit, or friction fit onto a vertical member of the tubular end frame. A lateral support member attached to the end frames determines the different shelf heights with a side member resting on the frame cross members. In one embodiment, an angled end placed on the side members contacts the frame cross members, securely holding the bottom portion of a shelf. The top of the shelf being held by the U-shaped side end retainers and the bottom of the shelf being held by the angled ends results in a secure, rigid, easily assembled storage rack structure. In another embodiment, the storage rack has a triangular shape. The storage rack of the present invention can be easily assembled without any tools and is easily manufactured and shipped unassembled.

20 Claims, 5 Drawing Sheets

STORAGE RACK

FIELD OF THE INVENTION

The present invention relates in general to a storage rack that is shipped and purchased unassembled by a consumer, and particularly to a storage rack that is easily assembly by a consumer and that is structurally sound.

BACKGROUND OF THE INVENTION

Consumers generally have a need and desire for storage racks to organize a variety of items. Storage racks are generally sold for use in kitchens, bathrooms, or anywhere storage racks or shelving is desired. Generally, storage racks are relatively inexpensive and purchased by a consumer unassembled. Storage racks typically require tools for assembly. Even with the use of tools, after assembly their component parts may be relatively loose fitting. Additionally, some storage racks utilize a pin inserted into a hole for assembly. This pin inserted into a hole assembly technique complicates the manufacturing process and, additionally, often results in misalignment or difficult alignment of the component parts. Therefore, the consumer often has a difficult time assembling the storage shelf. This difficulty to assemble is often frustrating to the consumer. Therefore, there is a need for a storage rack that can be easily assembled without the need of any tools and that is easy to manufacture and may be shipped unassembled for purchase by a consumer. Additionally, there is a need for the storage rack to be strong and secure.

SUMMARY OF THE INVENTION

The present invention comprises a storage rack having shelving that is friction fit, snap fit, or press fit into place providing a secure and easily assembled storage rack. Two end frames are separated and held together by shelves having U-shaped retainers that wrap around the tubular end of the frame. A cross member placed on the end frame mates with angled ends on the shelf for positioning the height of the shelf and adding to the structural stability of the assembled storage rack. The shelves may be covered with wire mesh.

It is an object of the present invention to provide an easily assembled storage rack.

It is a further object of the present invention to provide a storage rack that is secure having tight fitting components once assembled.

It is an advantage of the present invention that no tools are required for assembly.

It is a further advantage of the present invention that the component parts are easy to align.

It is a feature of the present invention that each shelf has U-shaped retainers that securely hold the end frame.

It is another feature of one embodiment of the present invention that angled ends on the shelves interact with cross members on the end frame.

It is a further feature of the present invention that mesh or wire shelves are used.

These and other objects, advantages, and features will become readily apparent in view of the following detailed description.

IN THE DRAWINGS

Figure 4A:
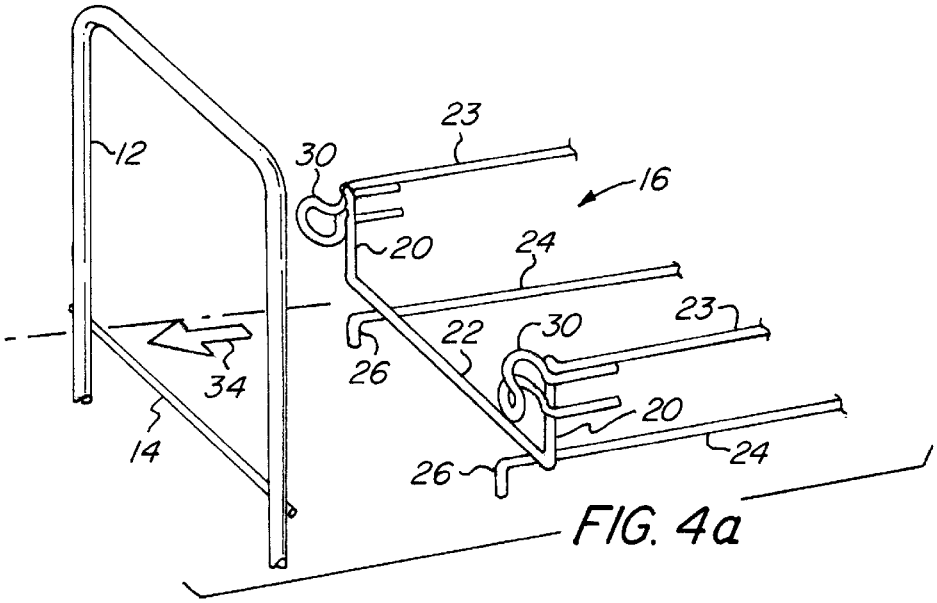
Figure 4B:
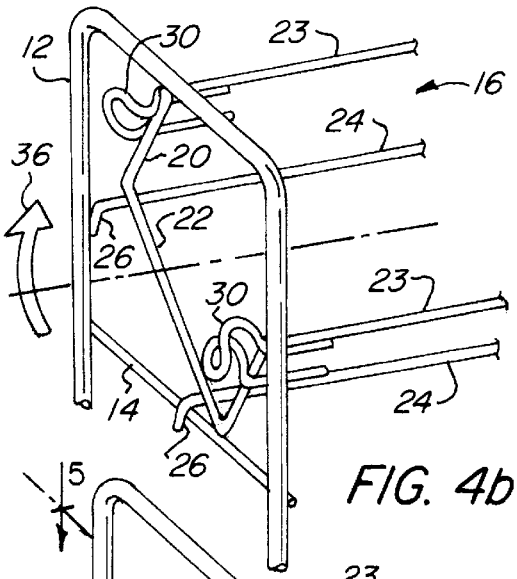
Figure 4C:
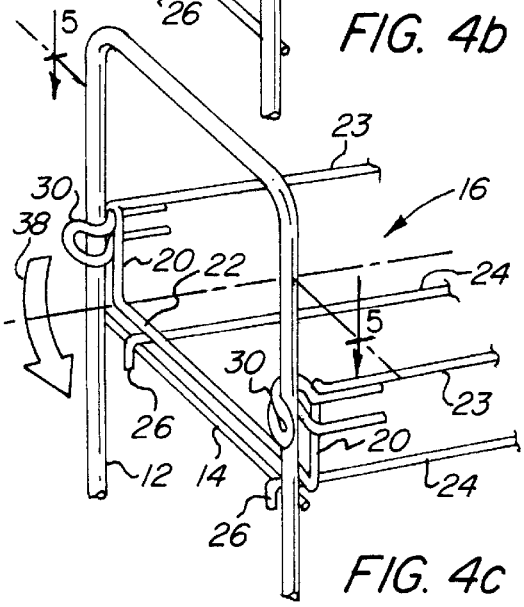

FIGS. 4*a–c* illustrate the sequential assembly of a shelf.

Figure 5:
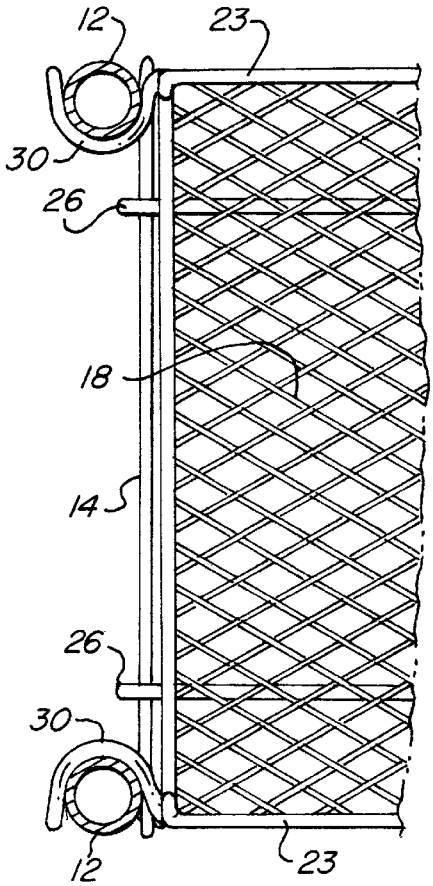

FIG. 5 is a partial plan view.

Figure 6:
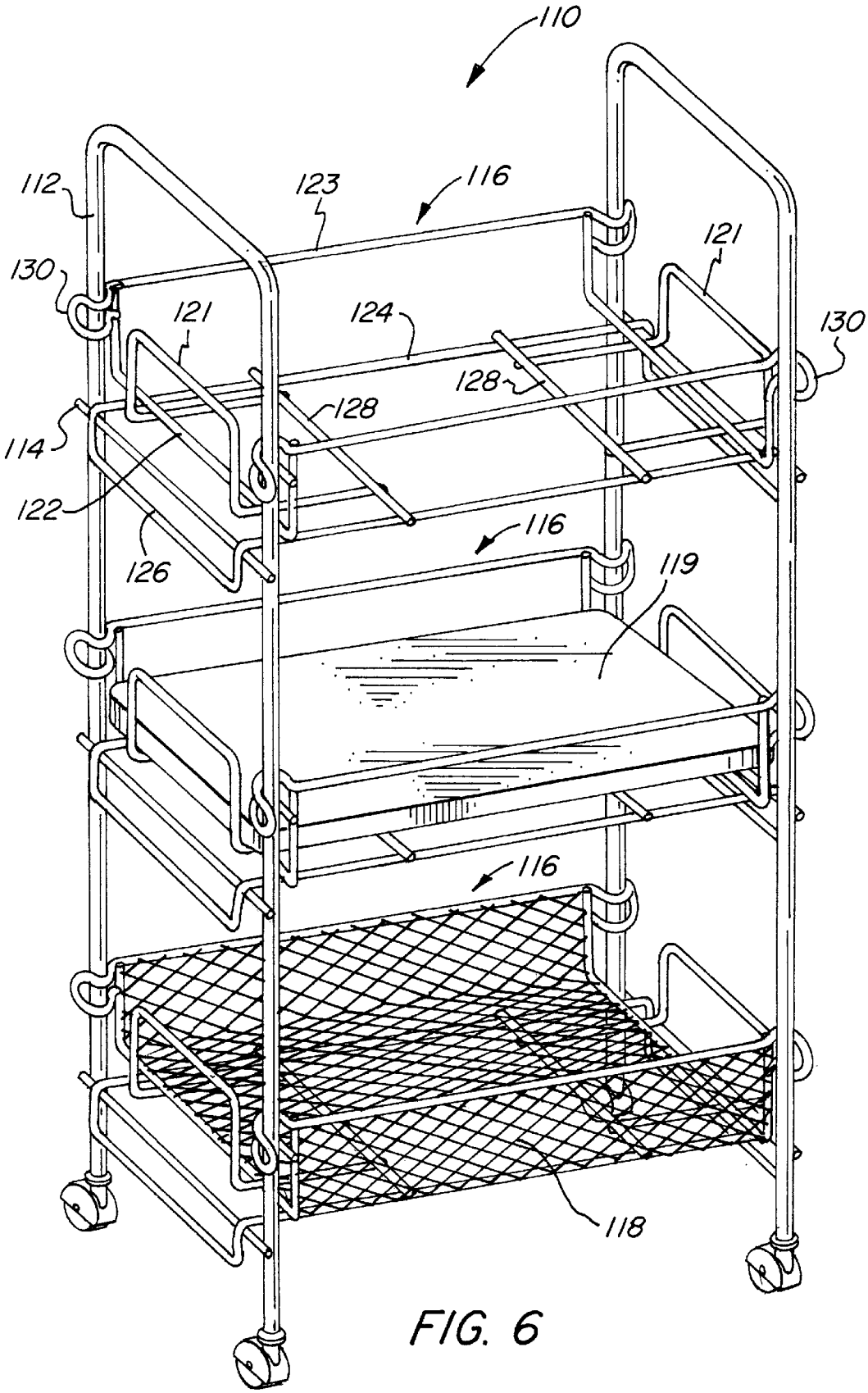

FIG. 6 is a perspective view of another embodiment of the present invention.

Figure 7:
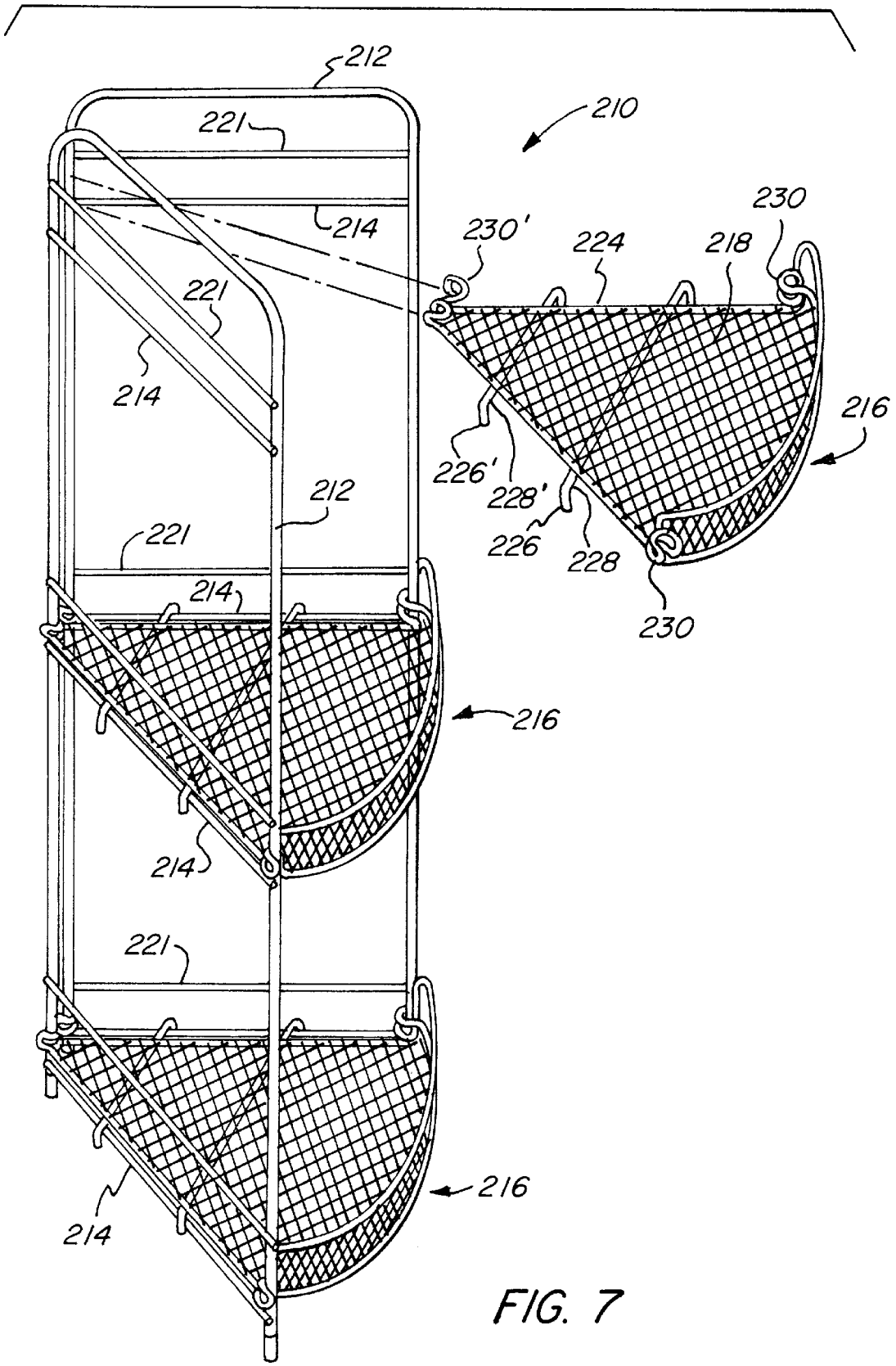

FIG. 7 is a perspective plan view of yet another embodiment of the present invention.

DETAILED DESCRIPTION OF THE PREFERRED EMBODIMENT

Figure 1:
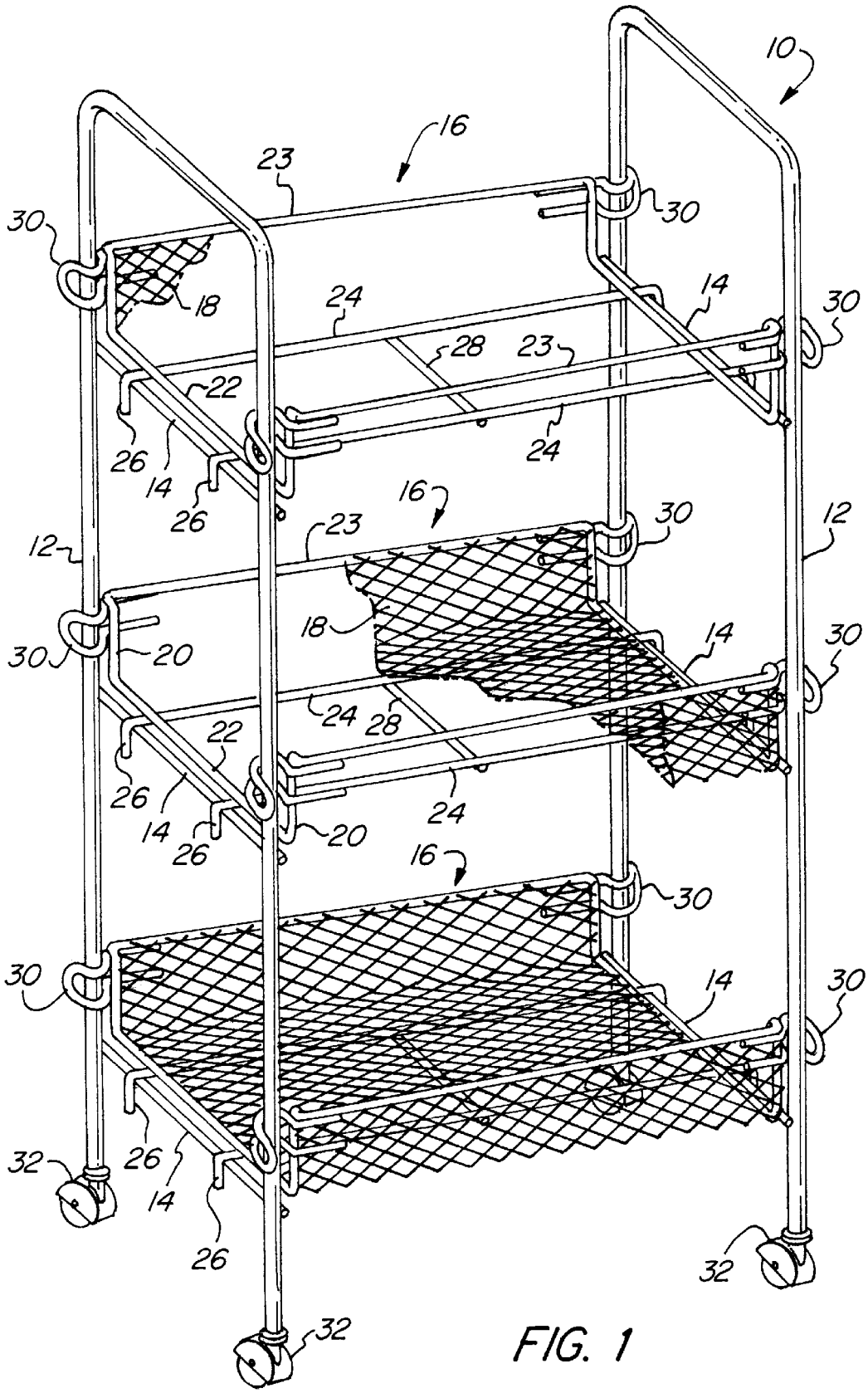
FIG. 1 is a perspective view of one embodiment of the present invention.

FIG. 1 is a perspective view of one embodiment of the present invention. Storage rack 10 has a pair of end frames 12. The end frames 12 are made from a tubular material, and are preferably cylindrical. The components of the storage rack 10 may be made of any suitable material, for example metal or plastic. End frames 12 have frame cross members 14. The frame cross members 14 are positioned at the desired or predetermined shelf height. The frame cross members 14 are illustrated as being positioned on the inside of the end frames 12, but may be placed on the outside of the end frames 12. The frame cross members 14 additionally provide stability and support to the end frames 12. A plurality of shelves 16 having wire mesh 18 surfaces are placed on the frame cross members 14 and the end frames 12. The shelves 16 are comprised of side end members 20, bottom lateral end members 22, top longitudinal side members 23, bottom longitudinal side members 24, angled ends 26, lateral center support 28, and side end retainers 30. The storage rack 10 may also have wheels 32 thereon. The shelves 16 are supported on the end frame 12 by frame cross members 14. The bottom longitudinal side members 24 have an angled end 26. The angled end 26 contacts the frame cross members 14 and helps to stabilize the storage rack 10. The side end retainers 30 are positioned on side end members 20. The side end retainers 30 are U-shaped and are sized to firmly grasp the end frame 12. The side end retainers 30 may extend around a substantial portion of the circumference or perimeter of the vertical members of the end frames 12. The side end retainers 30 may form a snap fit, press fit, or friction fit to the end frame 12. Additionally, the side end members 20 may be angled outward slightly so as to provide an outward spring force or bias, assuring that the side end retainers 30 maintain contact with the vertical members of the end frame 12. Therefore, the distance between the side end retainers 30 may be greater than the distance between the vertical members before assembly. The frame cross members 14 therefore are additionally utilized to prevent the vertical members of the end frame 12 from spreading apart.

The storage rack 10, generally, is shipped unassembled with the shelves 16 removed from the end frames 12. The unassembled storage rack is therefore easily shipped and displayed for the consumer in a small package which may be easily carried. The consumer may then easily and conveniently assemble the storage rack simply by separating the end frames 12 and inserting the shelves 16 without the need for any tools or troublesome and frustrating alignment of pins and holes. The storage rack of the present invention can be assembled much more quickly than prior storage racks, and once assembled, is structurally very sound. The shelves 16 are well supported with no threaded fasteners to loosen over time.

Figure 2:
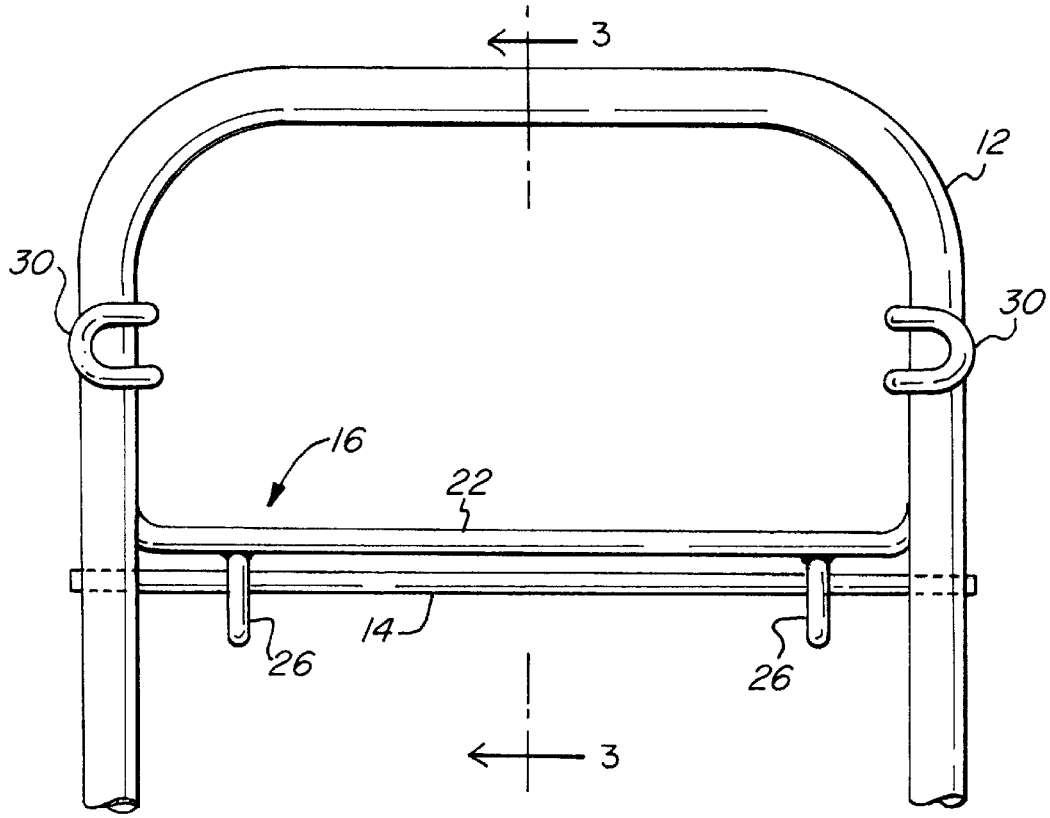
FIG. 2 is a front elevational view of a portion of the embodiment illustrated in FIG. 1.

FIG. 2 is a side elevational view illustrating a portion of the storage rack more clearly showing the positioning of a shelf 16. The frame cross member 14 is welded or otherwise attached or affixed to the end frame 12. The bottom lateral end member 22 is welded or otherwise affixed to bottom longitudinal side members that have the angled ends 26 thereon. The angled ends 26 secure the bottom of the shelf 16 and prevent it from sliding sideways or longitudinally within the storage rack. The side end retainers 30 have one leg of the U-shape wrapping around the outside of the vertical member of the end frame 12. The U-shaped side end retainers 30 firmly hold the vertical members of the end frame 12 on the open top of the shelf 16. Therefore, the shelf 16 is securely held within the end frame 12 at both the open top and closed bottom thereof. Additionally, the side end retainers 30 may be biased outward slightly more than the distance between the vertical members or tubes of the end frame 12. This assures that the side end retainers maintain firm contact with the end frame 12 and are biased firmly against the vertical members of the end frame 12.

Figure 3:
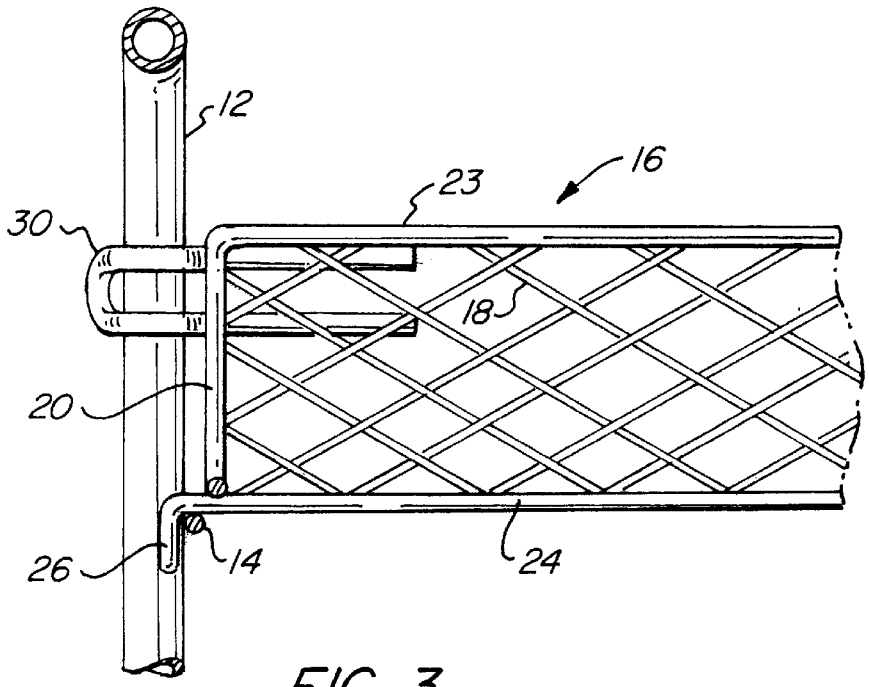
FIG. 3 is a cross section taken along lines 3—3 in FIG. 2.

FIG. 3 is a cross section taken along line 3—3 in FIG. 2. FIG. 3 clearly illustrates the side end retainer 30 gripping the end frame 12 near the top of the shelf 16. The bottom of the shelf 16 is securely held by the angled end 26 formed on the bottom longitudinal side member 24. The angled end 26, in combination with the frame cross member 14, stabilizes the shelf 16. This structure provides an easily assembled very rigid storage rack.

FIGS. 4*a*–*c* illustrate the method of assembling the storage rack and inserting a shelf into the end frame 12. Only the frame of the shelf is illustrated for clarity, with the wire mesh not being illustrated. Referring to FIG. 4*a*, one end of the shelf 16 is inserted, in the direction indicated by arrow 34, between the two vertical members of the end frame 12. Referring to FIG. 4*b*, the shelf 16 may be rotated slightly, in the direction indicated by arrow 36, to facilitate the insertion of the end of the shelf 16 between the two vertical members of the end frame 12. Referring to FIG. 4*c*, after the shelf 16 is inserted, the shelf is rotated, in the direction indicated by arrow 38, so that the U-shaped side end retainers 30 are firmly wedged with a snap fit, friction fit, or press fit to the vertical members of end frame 12. The vertical members of the end frame 12 are prevented from spreading due to the close proximity of the frame cross members 14. The frame cross members 14 determine the height of the shelf 16. The side end retainers 30 may be welded or otherwise attached to the top longitudinal side members 23 and the side end members 20. The distance between the top longitudinal side members 23 may be made slightly larger than a distance between the vertical members of the end frame 12. Accordingly, the side end retainers 30 may be biased outward slightly, providing a very secure and rigid attachment. All the shelving units or shelves 16 in the storage rack are assembled similarly. The wire mesh has not been illustrated in FIGS. 4*a*–*c* for purposes of clarity. However, it should be appreciated that generally the shelves 16 are covered with wire mesh.

FIG. 5 is a plan view of a portion of the assembled storage rack more clearly illustrating the side end retainers 30 against the end frame 12. FIG. 5 is a cross section taken along line 5—5 in FIG. 4*c*. However, the wire mesh 18 has been included in FIG. 5 whereas in FIG. 4*c*, it has been removed for clarity.

FIG. 6 is a perspective view of another embodiment of the present invention having a slightly modified structure. It should be appreciated that slightly different structures may be provided while achieving the same benefits in practicing the teachings of the present invention. A storage rack 110 is comprised of a plurality of shelves 116. The height of shelves 116 is determined by frame cross member 114. The shelves may be formed from a wire mesh 118 or have a board 119 as a bottom. Side handles 121 may be utilized to retain articles within the shelves 116 or used to assist in removing the shelves 116. The shelves 116 have a top longitudinal side member 123 and a bottom longitudinal side member 124. Lateral center supports 128 may be placed laterally across the bottom longitudinal side members 124. A bottom lateral end member 122 may be used to provide additional structure for the shelves 116. Angled ends 126 are retained in position by the frame cross members 114 and prevent sideways movement of the shelf 116. Side end retainers 130 securely hold the top of the shelf 116 to each vertical member or tube of the end frame 112. The top shelf 116 has been illustrated for clarity without a wire mesh or a board bottom. However, it should be appreciated that either surface or other surfaces may be applied to the frame of the top shelf 116 or any of the other shelves 116.

FIG. 7 is a perspective view of another embodiment of the present invention that is in the form of a wedge shape or triangular shelving unit. This embodiment may be placed or fitted in the corner of a room between two walls. The wedge or triangular shaped storage rack 210 has a plurality of shelves 216. The shelves 216 fit between two end frames 212 with the height of the shelves 216 determined by the frame cross members 214. The frame cross members 214 are illustrated as being placed on the outside of the end frames 212, but may be placed on the inside of end frames 212. A side rail 221 may be placed slightly above the frame cross member 214 to retain articles or prevent articles from falling off of the shelf 216. The lateral supports 228' and 228 may be attached to the bottom longitudinal side members 224 and rest on the frame cross members 214. However, the side rails 221 and the lateral supports 228' and 228 may not be needed in some applications. The angled ends 226 and 226' help prevent any sideways motion of the shelf 216 once placed between the end frames 212. In a commercial embodiment the side rails 221, lateral supports 228' and 228, and angled ends 226 and 226' may be eliminated without compromising the integrity, strength, or usefulness of the shelving unit or storage rack 210. Therefore, these elements may not be necessary in practicing the present invention, and in some applications eliminated to save cost. The wedge or triangular shaped storage rack 210 has sufficient strength and rigidity without these elements, however they may be included if desired. At the vertex of the shelf 216 are side end retainers 230' which hold onto a vertical member or tube of the frame 212 near the vertex of the storage rack 210. Side end retainers 230 similarly are securely attached to the vertical members or tubes on the end frames 212. Therefore, when the shelves 216 are securely placed within or between the end frames 212, the storage rack 210 has a rigid and secure structure.

Accordingly, it should be appreciated that the storage rack of the present invention may take different forms, but in all embodiments provides a storage rack that is easily assembled and provides a very rigid structure that will securely hold many different articles. The storage rack of the present invention may be assembled without any tools, and is relatively easily manufactured. The structure of the present invention also avoids many alignment problems associated with prior storage racks that have pins or bolts inserted into holes. The storage rack of the present invention does not require the drilling of any holes, which avoids manufacturing steps as well as maintains the integrity of the tubes used in the storage rack.

Although the preferred embodiment has been illustrated and described, it will be obvious to those skilled in the art that various modifications may be made without departing from the spirit and scope of this invention.

What is claimed is:

1. A storage rack comprising:

a pair of end frames, said pair of end frames having vertical members positioned a first distance apart;

a plurality of cross members placed between the vertical members of each of said pair of end frames;

a plurality of shelves placed between said pair of end frames, each of said plurality of shelves resting on one of said plurality of cross members an end placed on each of said shelves and adapted to mate with a corresponding one of said plurality of cross members; and a U-shaped retainer placed on either end of said plurality of shelves, said U-shaped retainer adapted to hold a substantial portion of the vertical members of said pair of end frames, whereby the storage rack may be assembled without tools.

2. A storage rack as in claim 1 further wherein; said end comprises and angled end.

3. A storage rack as in claim 2 wherein:

said U-shaped retainer is placed on one side of each of said plurality of shelves, and said angled end is placed on an opposite side of each of said plurality of shelves.

4. A storage rack as in claim 1 wherein:

each of said plurality of shelves is triangular.

5. A storage rack as in claim 1 further comprising:

mesh placed on each of said plurality of shelves.

6. A storage rack as in claim 1 wherein:

a pre-assembled distance between said U-shaped retainer placed on either end of said plurality of shelves is greater than said first distance between the vertical members of said pair of end frames.

7. A storage rack as in claim 1 further comprising:

a side rail placed adjacent each of said plurality of cross members.

8. A storage rack comprising:

a first end frame having a first pair of vertical members;

a second end frame having a second pair of vertical members;

a first cross member attached to said first end frame between the first pair of vertical members;

a second cross member attached to said second end frame between the second pair of vertical members;

a shelf an end placed on either end of said longitudinal member, said end adapted to extend over said first and second cross member; and a U-shaped retainer placed on each end of said shelf, said U-shaped retainer adapted to fit the first and second pair of vertical members, whereby the storage rack may be assembled without tools.

9. A storage rack as in claim 8 wherein:

said U-shaped retainer fits the first and second pair of vertical members with a snap-fit.

10. A storage rack as in claim 8 wherein:

said U-shaped retainer fits the first and second pair of vertical members with a press-fit.

11. A storage rack as in claim 8 wherein:

said U-shaped retainer fits the first and second pair of vertical members with a friction-fit.

12. A storage rack as in claim 8 wherein:

said U-shaped retainer circumscribes a substantial portion of said first and second pair of vertical members.

13. A storage rack as in claim 8 further comprising:

a bottom longitudinal member; and wherein said end is an angled end.

14. An unassembled storage rack comprising:

a first U-shaped tubular end frame having a first pair of vertical members;

a first plurality of frame cross members placed at different locations between the first pair of vertical members with a circumference;

a second U-shaped end frame having a second pair of vertical members with a circumference;

a second plurality of frame cross members placed at different locations between the second pair of vertical members;

a plurality of mesh shelves, each of said plurality of mesh shelves having an open top and a closed bottom;

a U-shaped side end retainer placed at each corner adjacent the open top of each of said plurality of mesh shelves, said U-shaped side end retainer adapted to fit around a substantial portion of the circumference of each of the first and second pair of vertical members of said first and second end frames;

a pair of bottom side members placed on the closed bottom of each of said plurality of mesh shelves, each of said pair of bottom side members having angled ends pointing away from the closed bottom of each of said plurality of mesh shelves and adapted to contact one pair of said first and second plurality of cross members when positioned between said first and second U-shaped tubular end frames; and wheels placed on said first and second U-shaped tubular end frames, whereby the unassembled storage rack is packaged and sold to consumers for assembly without tools forming a study storage rack.

15. An unassembled storage rack as in claim 14 wherein:

said plurality of mesh shelves have the shape of a rectangular shape.

16. An unassembled storage rack as in claim 14 wherein:

said plurality of mesh shelves have the shape of a triangular shape.

17. An unassembled storage rack comprising:

a pair of end frames, each of said pair of end frames having a pair of vertical members;

a plurality of shelves having bottom closed end and a top open end;

means, attached to the pair of vertical members, for supporting each of said plurality of shelves;

means, attached to the top open end of each of said plurality of shelves, for fitting a substantial portion around each of the pair of vertical members; and means, attached to the bottom closed end of each of said plurality of shelves, for contacting said means for supporting each of said plurality of shelves, whereby the storage rack may be easily assembled by a consumer.

18. A method of assembling a storage rack comprising the steps of:

inserting a shelf having U-shaped side end retainers through a portion of an end frame at an angle relative to vertical members of the end frame;

rotating the shelf so that the U-shaped side end retainers grasp the vertical members of the end frame; and positioning an angled end on the shelf adjacent a frame cross member between the vertical members of the end frame, whereby the storage rack is assembled without any tools forming a rigid structure.

19. A storage rack comprising:

a pair of end frames, said pair of end frames having vertical members positioned a distance apart, the vertical members having a perimeter;

a plurality of cross members placed between the vertical members of each of said pair of end frames;

a plurality of shelves placed between said pair of end frames, each of said plurality of shelves resting on one of said plurality of cross members, each of said plurality of shelves having a top longitudinal side member and a bottom longitudinal side member;

angled ends placed on either end of each of said plurality of shelves adjacent the bottom longitudinal side member and contacting one of said plurality of cross members; and a side end retainer placed on either end of said plurality of shelves adjacent the top longitudinal side member, said side end retainer extending around a substantial portion of the perimeter of the vertical member, whereby the vertical member is grasped around the perimeter by said side end retainer, whereby the storage rack may be assembled without tools and the need to align a hole.

20. A storage rack comprising:

a pair of end frames, said pair of end frames having vertical members positioned a distance apart, the vertical members having a circumference;

a plurality of cross members placed between the vertical members of each of said pair of end frames;

a plurality of shelves placed between said pair of end frames, each of said plurality of shelves resting on one of said plurality of cross members, each of said plurality of shelves having a top longitudinal side member and a bottom longitudinal side member;

angled ends placed on either end of each of said plurality of shelves adjacent the bottom longitudinal side member and contacting one of said plurality of cross members; and a side end retainer placed on either end of said plurality of shelves adjacent the top longitudinal side member, said side end retainer being U-shaped having an open end and a closed curved end, the open end receiving the vertical member and the closed curved end extending around a substantial portion of the circumference of the vertical member, whereby the vertical member is grasped around the circumference by said side end retainer, whereby the storage rack may be assembled without tools and the need to align a hole.

* * * * *